United States Patent [19]

Varner

[11] Patent Number: 5,070,962

[45] Date of Patent: Dec. 10, 1991

[54] EGRESS AND EVACUATION HARNESS

[75] Inventor: Horace M. Varner, Littleton, Colo.

[73] Assignee: Frost Engineering Development Corporation, Englewood, Colo.

[21] Appl. No.: 554,540

[22] Filed: Jul. 18, 1990

[51] Int. Cl.[5] ..... A62B 1/02; A62B 35/00

[52] U.S. Cl. ..... 182/7

[58] Field of Search ..... 182/3, 4, 5, 6, 7

[56] References Cited

U.S. PATENT DOCUMENTS

| | | | |
|---|---|---|---|
| 296,769 | 4/1884 | Miller et al. | 182/7 |
| 2,680,593 | 6/1954 | McIntyre | 182/7 |
| 4,308,629 | 1/1982 | Freemon | 182/3 |

*Primary Examiner*—Reinaldo P. Machado

*Attorney, Agent, or Firm*—Ralph F. Crandell

[57] ABSTRACT

An egress and evacuation harness consisting of a single piece of strong, flexible material cut to a generally sector-shaped T-shaped pattern, the ends of which are secured together to form a seat. A shoulder strap secures a wearer in the seat.

1 Claim, 2 Drawing Sheets

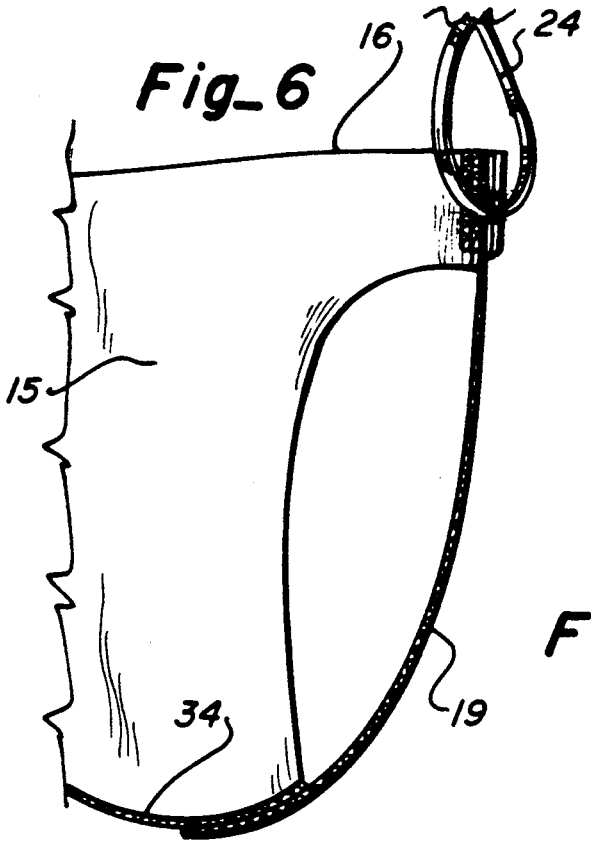
Fig_6
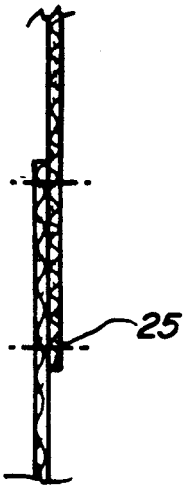
Fig_7
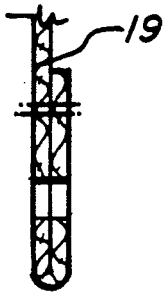
Fig_8
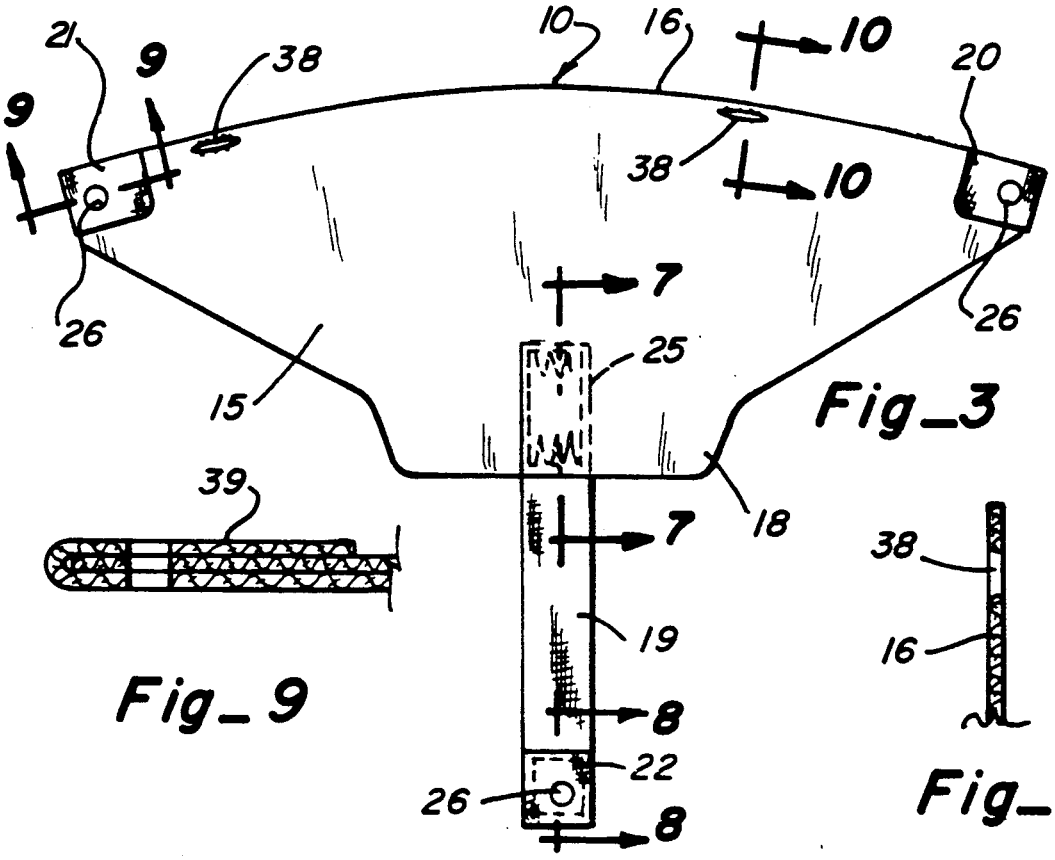
Fig_3
Fig_9
Fig_10

EGRESS AND EVACUATION HARNESS

BACKGROUND OF THE INVENTION

1. Field of The Invention

The present invention relates to a harness or sling for use with a descent controller and rope for supporting a person on the descent controller for controlled descent along the rope.

2. Brief Description of The Prior Art

Various types of devices have been utilized to enable persons to lower themselves from overhead cranes, stockpickers, forklifts, extended-boom lift trucks, scaffolding, towers, buildings, and other high places.

The principal object of the present invention is to provide an easy-to-use egress and evacuation harness capable of fitting a large range of body sizes.

A further object is to provide a harness which affords excellent security and retention under normal and adverse circumstances.

In order to provide the safe descent of persons in a variety of situations including at work or at home, in a hotel or high-rise building, or in recreational pursuits, it is a further object to provide a harness which is relatively inexpensive and easy to produce, durable and capable of withstanding the forces imposed by an inadvertent fall or deliberate jump.

Still a further object is to provide a harness which provides support so that the user can reach and operate an attached lowering device.

Still another object is to provide a harness which affords excellent retention of the user in the event of an injury or accident that renders the person unconscious.

A related further object is to provide a harness which permits rescue personnel to place it on an unconscious or injured person with minimal movement of the person's limbs, trunk, or head.

SUMMARY OF THE INVENTION

The egress and evacuation harness embodying the present invention consists of a single piece of strong flexible material cut to the pattern shown on the attached drawing. A T-shape is used to form the harness. The bar at the top of the T provides two straps to wrap around the hips while the base of the T is a crotch strap which is placed between the legs. As an emergency egress harness, the three strap ends are attached to one another with a loop of webbing or a metal ring which is then attached to a suitable lowering device. In order to provide the requisite strength, the strap ends are reinforced with a suitable webbing.

Donning the harness requires placing one foot and leg into one of the openings first and then repeating the procedure for the other foot and leg. A strap is provided to hold the harness up onto the user's body.

The harness is sized to permit it to fit persons weighing up to 265 lbs., and the design allows persons ranging in weight from 100 to 265 lbs. to be properly supported. In addition, the configuration prevents the user from falling out because, when the occupant's body is inverted, the harness cinches around the hips providing good support.

When used in rescue situations, the harness ends are not permanently attached to one another. Thus, the harness can be laid out flat and slipped under the pelvis of the injured or unconscious person. Upon completion of that task, the strap ends are brought together and fastened with a carabiner, snap hook, or similar device.

Because the harness consists of a single piece of material with only three segments of reinforcing webbing, the cost, weight, and bulk are less than for harnesses constructed of multiple pieces of webbing, strapping, tape, and cloth. Lower weight and bulk permit the harness to be used in applications where these criteria are important, and lower cost allows it to be used in a greater number of situations and locations.

DESCRIPTION OF THE DRAWINGS

FIG. 3 is an enlarged layout of the harness shown in FIG. 1.

FIG. 6 is a section view taken substantially in the plane of line 6—6 on FIG. 4.

FIG. 7 is a section view taken substantially in the plane of line 7—7 on FIG. 3.

FIG. 8 is a section view taken substantially in the plane of line 8—8 on FIG. 3.

FIG. 9 is a section view taken substantially in the plane of line 9—9 of FIG. 3.

FIG. 10 is a section view taken substantially in the plane of line 10—10 of FIG. 3.

DESCRIPTION OF THE PREFERRED EMBODIMENT

Figure 1:
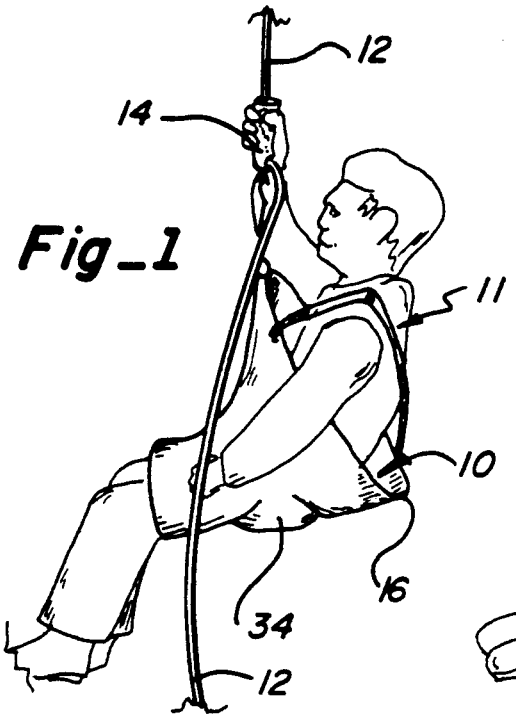
FIG. 1 is a perspective view of a harness embodying the present invention supporting a person for controlled descent along a rope.
Figure 2:
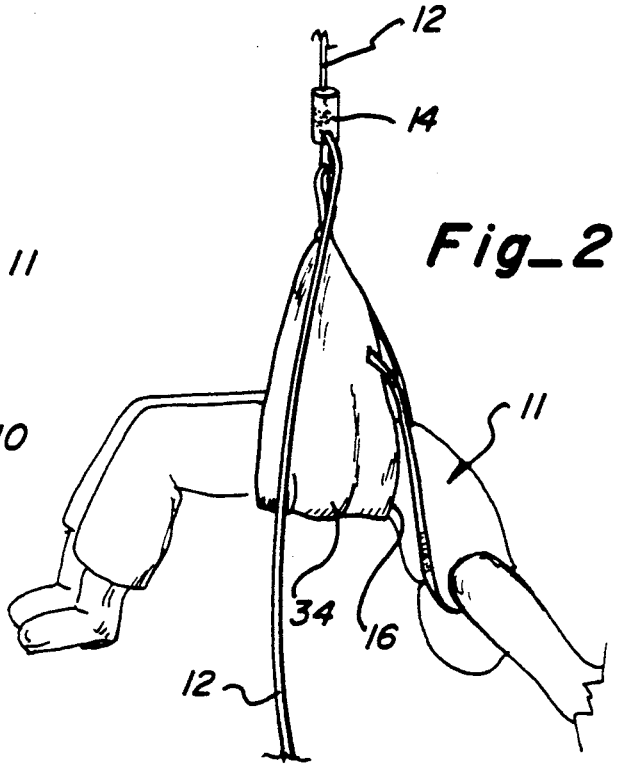
FIG. 2 is a perspective view similar to FIG. 1 but with the harness supporting an unconscious or injured person.
Figure 4:
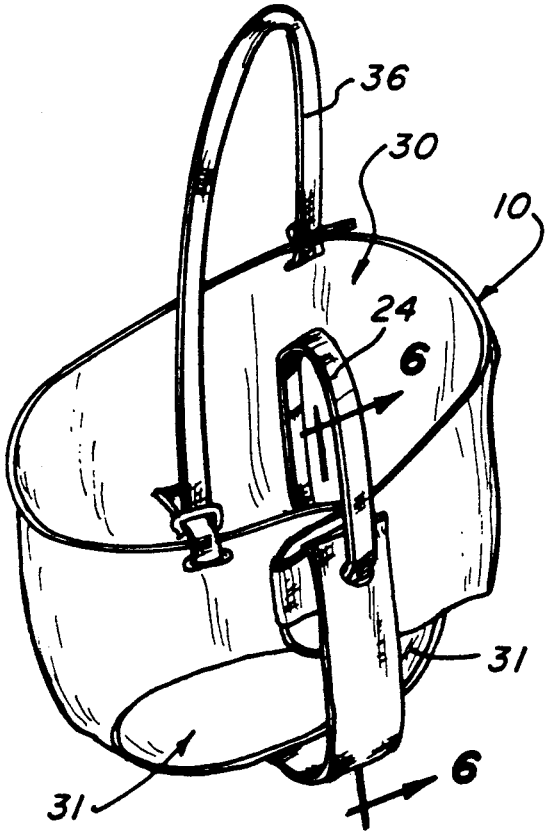
FIG. 4 is an enlarged perspective view of the harness shown in FIG. 1.

The egress and evacuation harness 10 embodying the present invention is adapted to support a person 11 either sitting as shown in FIG. 1 or unconscious, injured or reclining as shown in FIG. 2 for descent along a rope 12 under the control of a descent controller 14. An illustrative descent controller is shown in co-pending application Ser. No. 07554687 filed July 14, 1990 for Descent Controller, which application was filed on even date herewith. The harness consists of a single piece of strong, flexible material cut to the pattern shown in FIG. 3. Essentially this pattern comprises a truncated sector defining a generally triangular body portion 15 having a curved or arcuate edge 16 opposite to which is a generally rectangular panel 18 to which is secured a front or crotch strap 19. The generally T-shaped pattern thus formed is erected into a seat as shown in FIG. 4 by securing the two corners 20, 21 of the main panel 15 with the free end 22 of the strap 19. These pieces may be permanently secured or may be temporarily secured together by a strap 24 as shown in FIG. 4. The strap 24 is further connected to the descent controller and provides the main support for the harness.

The strap 19 is attached to the generally rectangular panel 18 by stitching 25 or may be integral therewith. Each of the corners 20 and 21 are defined with aperture 26 which may include grommets or the like. Similarly the end 22 of the strap 19 is likewise provided with an aperture 26 and may be provided with an appropriate grommet.

Figure 5:
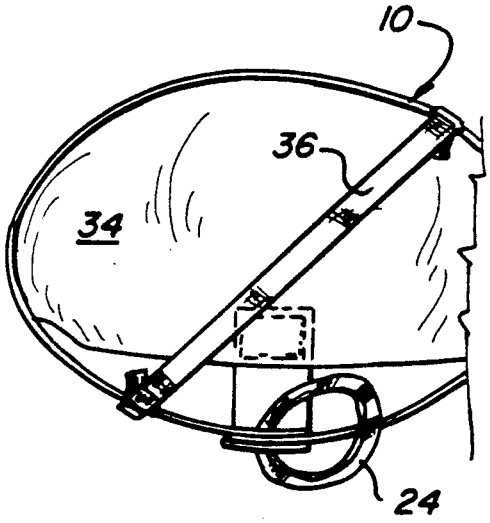
FIG. 5 is a top plan view of the harness shown in FIG. 4.

When erected as shown in FIG. 4, the harness provides a body opening 30 and opposed leg openings 31. Donning the harness requires placing one foot and leg into one of the openings 31 first then repeating the procedure for the other foot and leg. The body opening 30 surrounds the abdomen and lower portion of the torso of the user and the user is supported on the main area of the panel as a seat 34 as shown in FIG. 5.

To retain the harness on the wearer a shoulder strap 36 is secured between apertures or other mounting devices 38 on the panel.

Reinforcement 39 is provided adjacent each corner while the free end of the strap 19 may be doubled on itself as shown in FIG. 8 to provide a reinforcement.

As shown in FIG. 1 the user may sit in the harness and readily reach the descent controller 14. If the user is unconscious as shown in FIG. 2, the descent controller 14 may be actuated by pulling on the free end of the rope 12 to effect a slow, controlled descent of the unconscious user.

The harness is shaped to prevent a user from falling out when unconscious or injured as shown in FIG. 2.

While a certain illustrative embodiment of the present invention has been shown in the drawings and described above in detail it should be understood that there is no intention to limit the invention to the specific form disclosed. On the contrary, the intention is to cover all modifications, alternative constructions, equivalents and uses falling within the spirit and scope of the invention as expressed in the appended claims.

We claim:

1. A harness for supporting a wearer in either an upright or recumbent position during a controlled descent along a rope from a higher to a lower elevation, said harness comprising a panel of flexible material adapted to support the hips and torso of the wearer, said panel comprising a generally truncated sector-shaped portion defining a seat, said panel defining an arcuate edge forming the back edge of the seat and an opposite generally rectangular section forming the front portion of the seat, an elongated strap secured to said generally rectangular section and extending away from said arcuate edge, said panel and leg forming a generally T-shaped configuration, means for securing the opposite corners of said sector-shaped panel with the free end of said strap to define a generally bucket-shaped seat having an upper body opening and two lower leg openings, a shoulder strap connected to said panel and adapted to extend diagonally across the torso and shoulder of a person seated on the seat panel, and means attaching said descent controller to said securing means whereby a wearer is comfortably and safely retained within said harness seat during descent along said rope under the control of said descent controller.

* * * * *